US007896723B2

(12) United States Patent
Yang et al.

(10) Patent No.: US 7,896,723 B2
(45) **Date of Patent: *Mar. 1, 2011**

(54) METHOD FOR MAKING A SILICON QUANTUM DOT FLUORESCENT LAMP

(75) Inventors: Tsun-Neng Yang, Taipei (TW); Shan-Ming Lan, Taoyuan County (TW); Chin-Chen Chiang, Taoyuan County (TW); Wei-Yang Ma, Taipei County (TW); Chien-Te Ku, Taoyuan County (TW)

(73) Assignee: Atomic Energy Council - Institute of Nuclear Energy Research, Lungtan, Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/976,444

(22) Filed: Oct. 24, 2007

(65) Prior Publication Data

US 2010/0255747 A1 Oct. 7, 2010

(51) Int. Cl.
*H01J 9/00* (2006.01)

(52) U.S. Cl. ..... 445/25; 445/24; 445/22; 445/51; 427/64; 427/67

(58) Field of Classification Search ..... 313/495–497, 313/485–487; 445/24, 25, 49–51, 14, 22; 427/64, 69, 67, 71
See application file for complete search history.

(56) References Cited

U.S. PATENT DOCUMENTS

| | | | | |
|---|---|---|---|---|
| 5,442,254 | A * | 8/1995 | Jaskie | 313/485 |
| 5,455,489 | A * | 10/1995 | Bhargava | 315/169.4 |
| 5,882,779 | A * | 3/1999 | Lawandy | 313/485 |
| 7,132,783 | B1 * | 11/2006 | Kambe et al. | 313/496 |
| 7,569,984 | B2 * | 8/2009 | Yang et al. | 313/496 |
| 2010/0216266 | A1 * | 8/2010 | Yang et al. | 438/29 |

* cited by examiner

*Primary Examiner* — Mariceli Santiago
(74) *Attorney, Agent, or Firm* — Jackson IPG PLLC; Demian K. Jackson

(57) ABSTRACT

A silicon quantum dot fluorescent lamp is made via providing a high voltage source between a cathode assembly and an anode assembly. The cathode assembly is made by providing a first substrate, coating a buffer layer on the first substrate, coating a catalytic layer on the buffer layer and providing a plurality of nanometer discharging elements on the catalytic layer. The anode assembly is made via providing a second substrate, coating a silicon quantum dot fluorescent film on the second substrate with and coating a metal film on the silicon quantum dot fluorescent film.

16 Claims, 15 Drawing Sheets

METHOD FOR MAKING A SILICON QUANTUM DOT FLUORESCENT LAMP

BACKGROUND OF INVENTION

1. Field of Invention

The present invention relates to a silicon quantum dot fluorescent lamp and, more particularly, to a method for making a silicon quantum dot fluorescent lamp that efficiently transfers heat and provides a lot of electrons.

2. Related Prior Art

Fluorescent lamps containing mercury are often used. In such a lamp, electricity causes mercury vapor to discharge, thus generating ultraviolet light. The ultraviolet light excites three fluorescent materials to emit red, green and blue light, respectively. The mercury is however hazard to the environment.

In addition to Edison light bulbs and fluorescent lights, light emitting diodes ("LED") are getting more and more popular. A white-light LED is operated in three patterns as follows:

Firstly, a red-light LED, a green-light LED and a blue-light LED are used together. The illuminative efficiency is high. However, the structure is complicated for including many electrodes and wires. The size is large. The process is complicated for involving many steps of wiring. The cost is high. The wiring could cause disconnection of the wires and damages to the crystalline grains, thus affecting the throughput.

Secondly, a blue-light LED and yellow fluorescent powder are used. The size is small, and the cost low. However, the structure is still complicated for including many electrodes and wires. The process is still complicated for involving many steps of wiring. The wiring could cause disconnection of the wires and damages to the crystalline grains, thus affecting the throughput.

Thirdly, an ultra-light LED and white fluorescent powder are used. The process is simple, and the cost low. However, the resultant light includes two separate spectrums. A red object looks orange under the resultant light because of light polarization. The color-rendering index is poor. Furthermore, the decay of the luminosity is serious. The quality of fluorescent material deteriorates in a harsh environment. The lamp therefore suffers a short light and serious light polarization.

There is another serious problem with the LED-based lamps. If looking directly at an LED-based lamp, a person will feel very uncomfortable in the eyes because of the intensive light emitted from the LED-based lamp.

The present invention is therefore intended to obviate or at least alleviate the problems encountered in prior art.

SUMMARY OF INVENTION

The primary objective of the present invention is to provide a silicon quantum dot fluorescent lamp that transfer heat efficiently and provides a lot of electrons.

To achieve the foregoing objective of the present invention, a silicon quantum dot fluorescent lamp is made via providing a high voltage source between a cathode assembly and an anode assembly. The cathode assembly is made by providing a first substrate, coating a buffer layer on the first substrate, coating a catalytic layer on the buffer layer and providing a plurality of nanometer discharging elements on the catalytic layer. The anode assembly is made via providing a second substrate, coating a silicon quantum dot fluorescent film on the second substrate with and coating a metal film on the silicon quantum dot fluorescent film.

Other objectives, advantages and features of the present invention will become apparent from the following description referring to the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
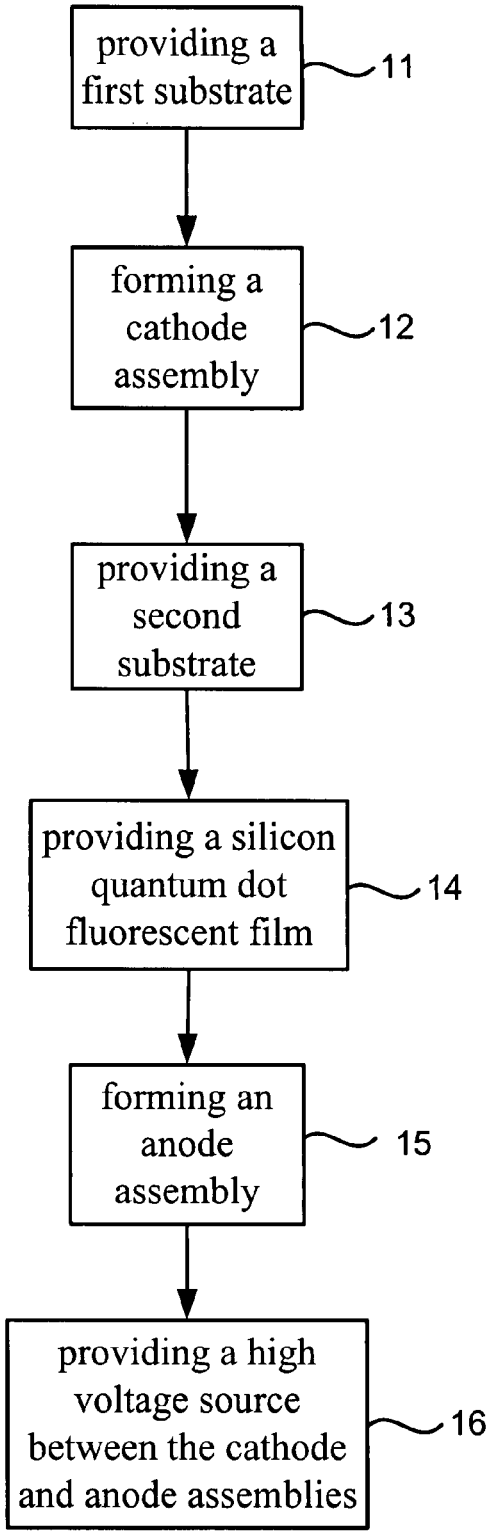
FIG. 1 is a flowchart of a method for making a silicon quantum dot fluorescent lamp according to the preferred embodiment of the present invention.

Referring to FIG. 1, there is shown a method for making a silicon quantum dot fluorescent lamp according to the preferred embodiment of the present invention.

Figure 2:
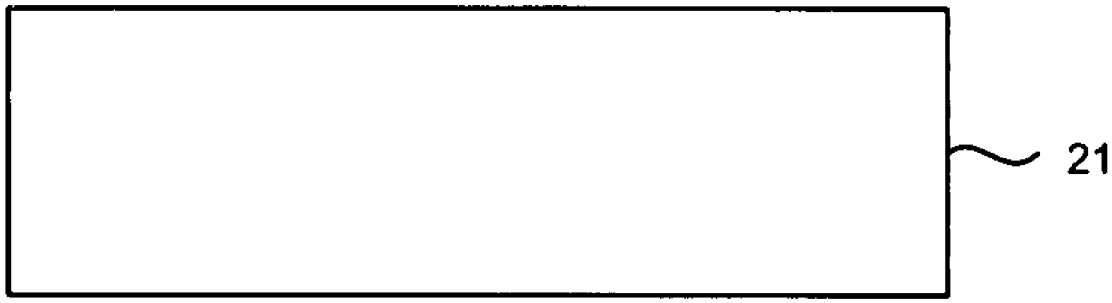
FIG. 2 is a side view of a first substrate for use in the method of FIG. 1.

Referring to FIGS. 1 and 2, at 11, a first substrate 21 is provided. The first substrate 21 may be made of silicon, glass, ceramic or stainless steel.

Figure 3:
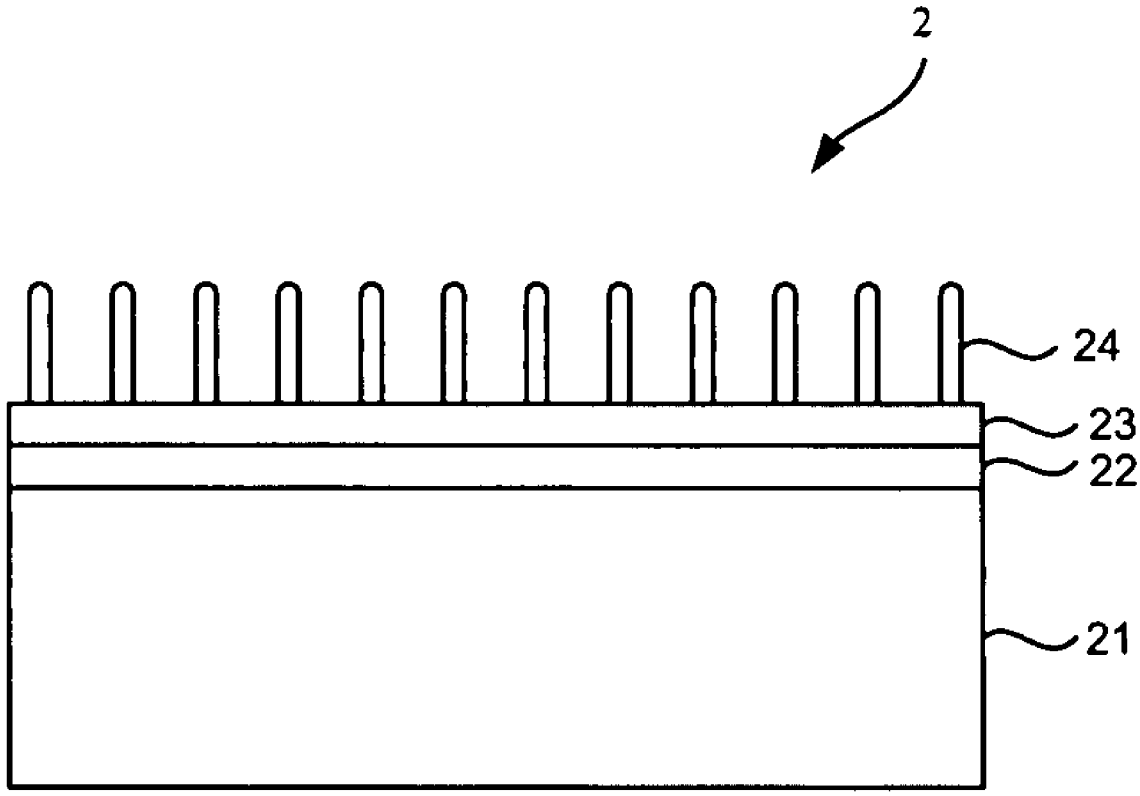
FIG. 3 is a side view of a cathode assembly including the first substrate shown in FIG. 2.
Figure 4:
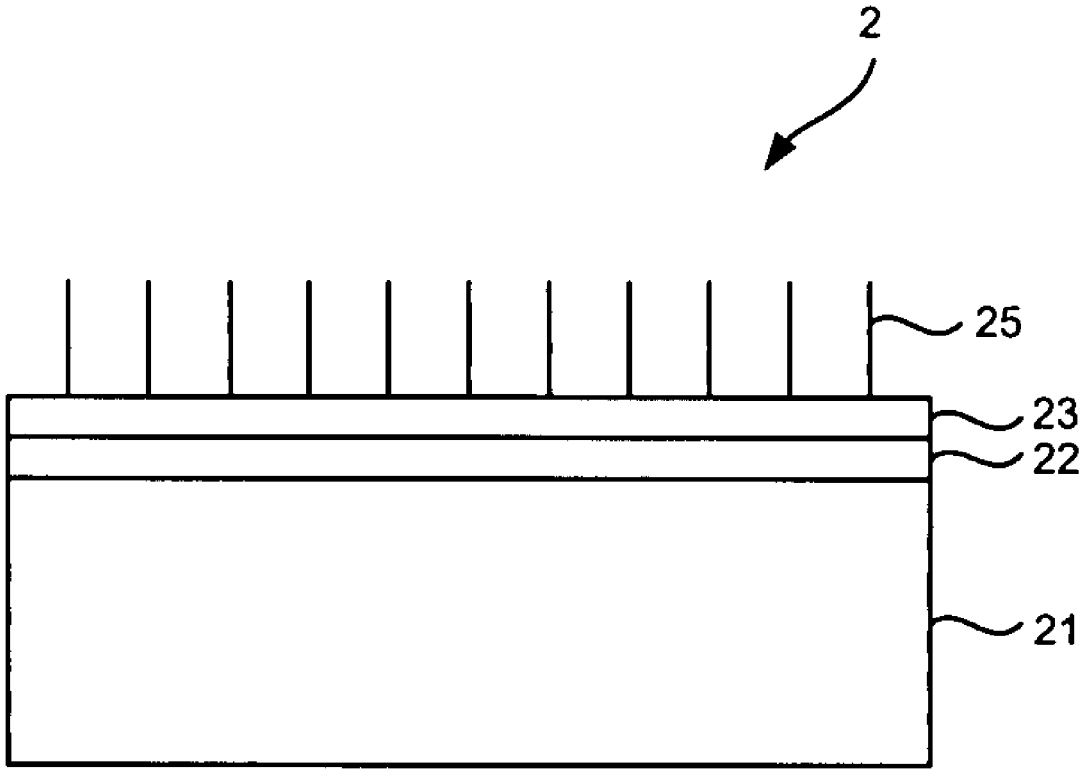
FIG. 4 is a side view of another cathode assembly including the first substrate shown in FIG. 2.

Referring to FIGS. 1, 3 and 4, at 12, the first substrate 21 is coated with a buffer layer 22, and the buffer layer 22 is coated with a catalytic layer 23. The coating is done in an e-gun evaporation system or a sputtering system. The buffer layer 22 is made of titanium. The catalytic layer 23 is made of nickel, aluminum or platinum. Referring to FIG. 3, nanometer carbon tubes 24 are provided on the catalytic layer 23 in a chemical vapor deposition ("CVD") process in which ethane or methane is used as a carbon source. Referring to FIG. 4, instead of the nanometer carbon tubes 24, nanometer silicon wires 25 are provided on the catalystic layer 23 in a CVD process in which monosilane or dichlorosilane is used as a silicon source. The nanometer carbon tubes 24 and nanometer silicon wires 25 are made of nanometer sizes and with conductivity.

Figure 5:
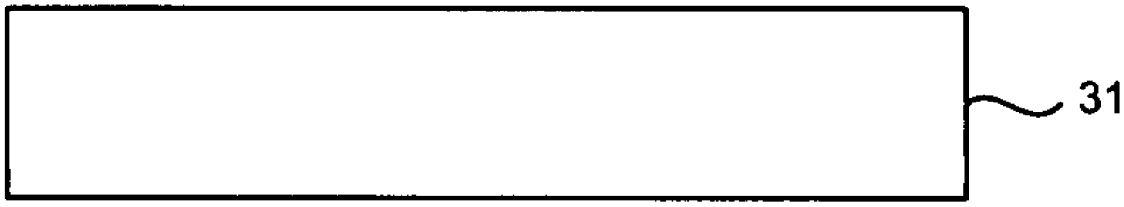
FIG. 5 is a side view of a second substrate for use in the method shown in FIG. 1.

Referring to FIGS. 1 and 5, at 13, a second substrate 31 is provided. The second substrate 31 is made of a transparent material such as glass, quartz and sapphire.

Figure 6:
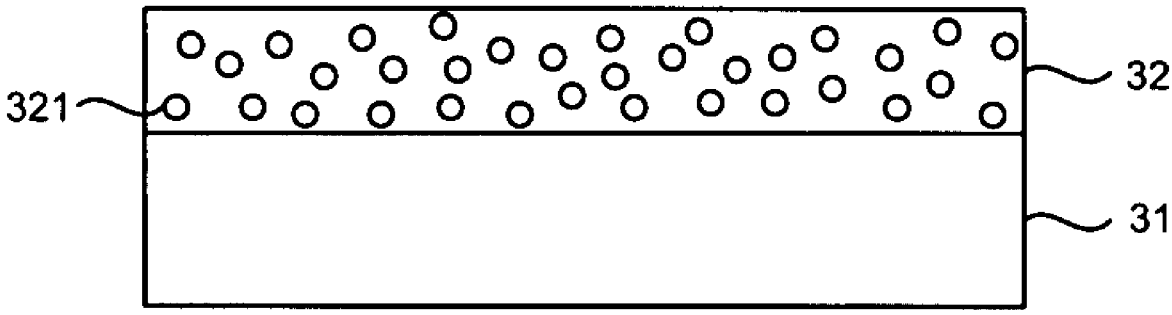
FIG. 6 is a side view of a silicon quantum dot fluorescent film on the second substrate shown in FIG. 2.

Referring to FIGS. 1 and 6, at 14, the second substrate 31 is coated with a silicon quantum dot fluorescent film 32 of a high dielectric coefficient in a CVD process. The silicon quantum dot fluorescent film 32 includes a plurality of silicon quantum dots 321 of various sizes of 1 to 10 nm. The silicon quantum dots 321 are evenly distributed in the silicon quantum dot fluorescent film 32. The silicon quantum dot fluorescent film 32 is a conductive or none-conductive matrix made of a material such as polymer, silicon oxide, silicon nitride and silicon carbide.

Figure 7:
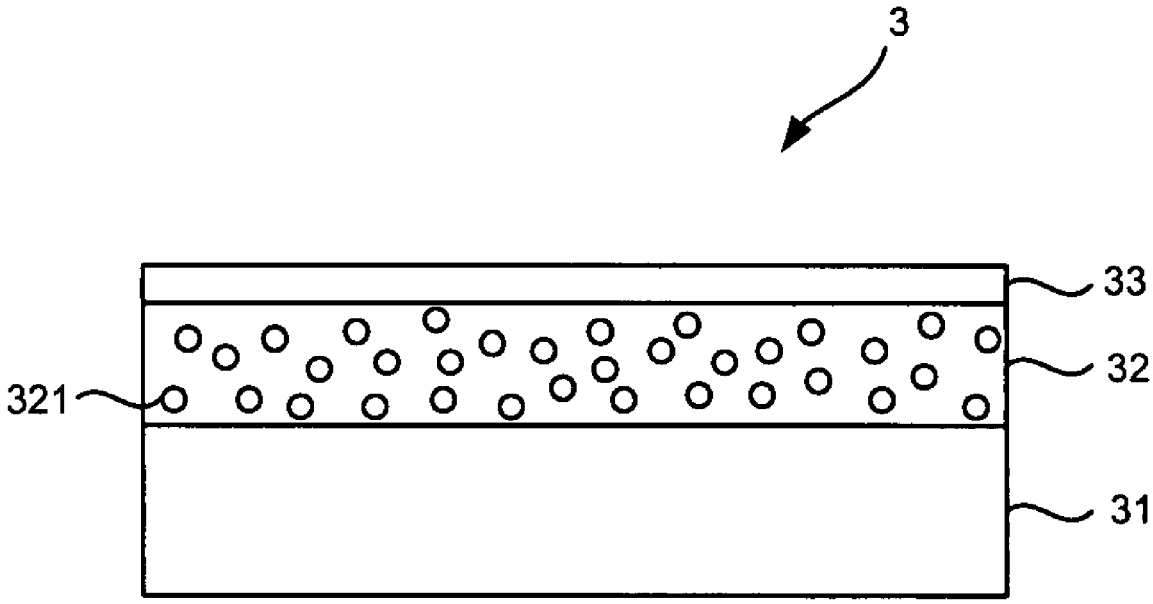
FIG. 7 is a side view of an anode assembly including the silicon quantum dot fluorescent film and the second substrate shown in FIG. 6.
Figure 8:
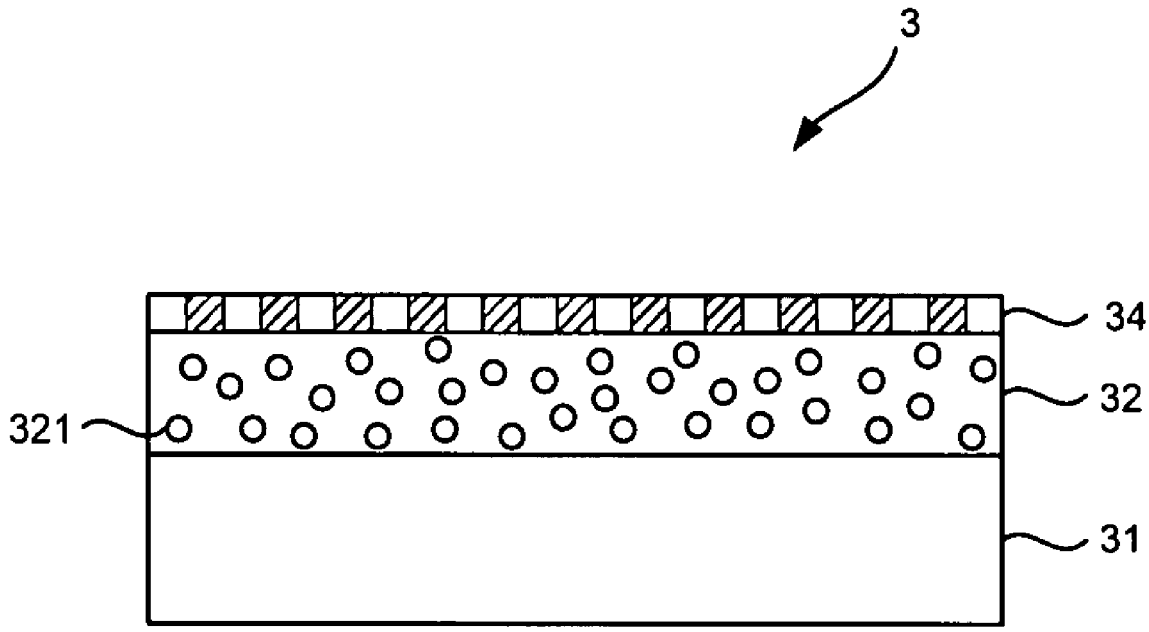
FIG. 8 is a side view of another anode assembly including the silicon quantum dot fluorescent film and the second substrate shown in FIG. 6.
Figure 9:
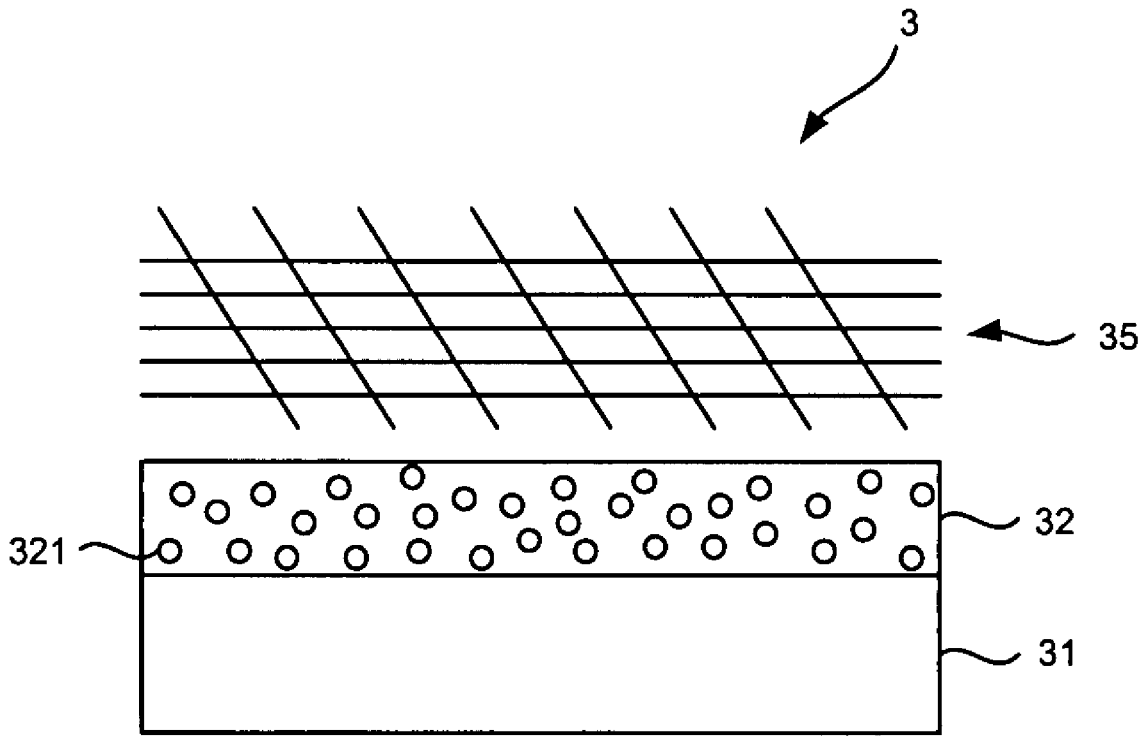
FIG. 9 is a side view of still another anode assembly including the silicon quantum dot fluorescent film and the second substrate shown in FIG. 6.
Figure 10:
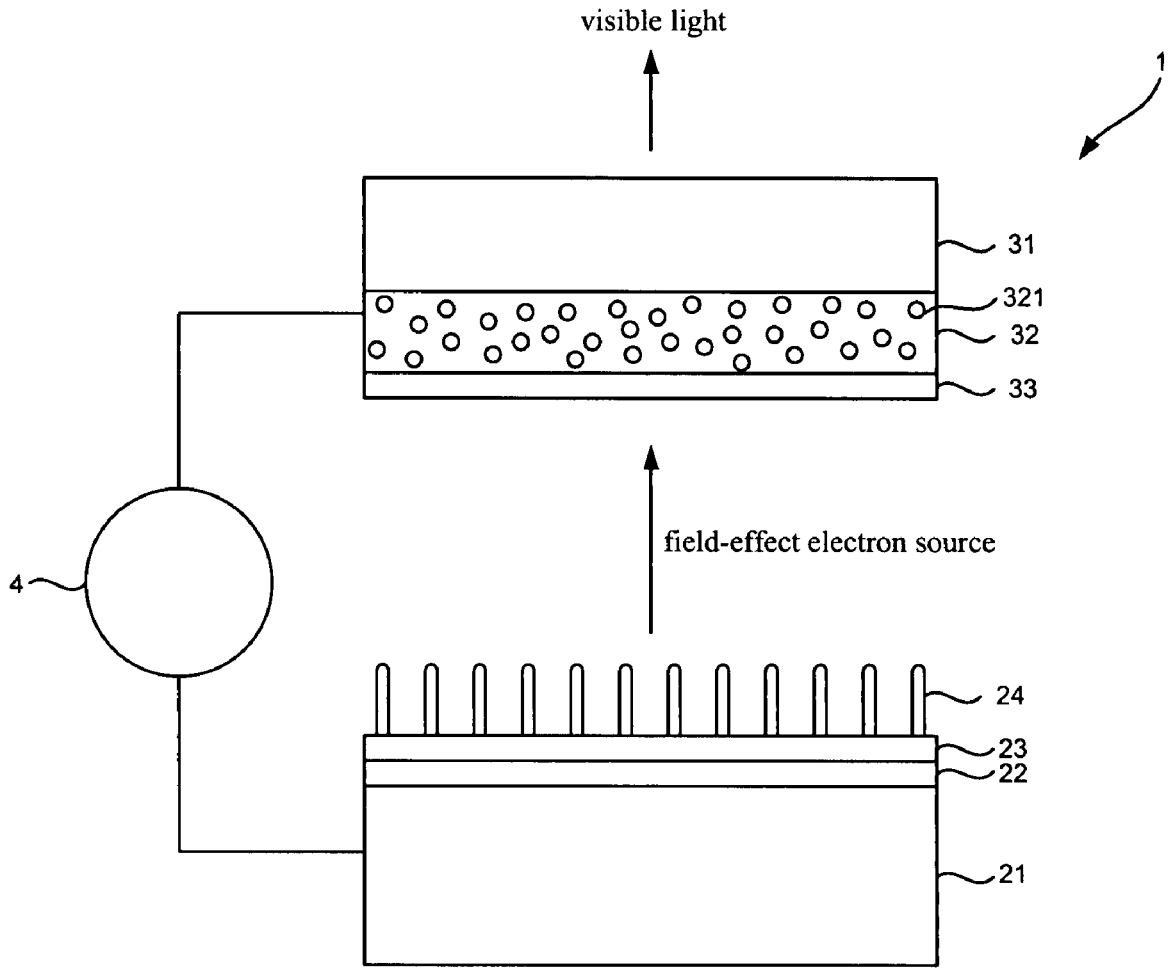
FIG. 10 is a side view of a silicon quantum dot fluorescent lamp including the cathode assembly shown in FIG. 3 and the anode assembly shown in FIG. 7.
Figure 11:
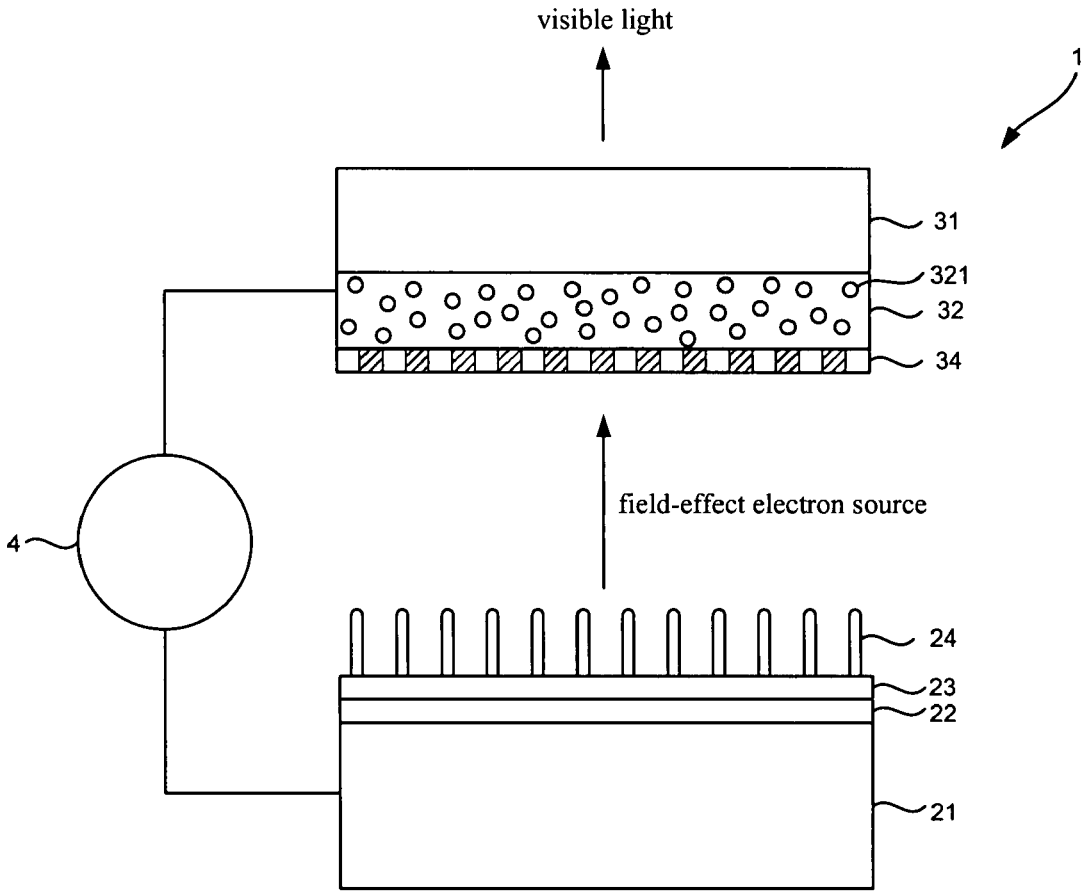
FIG. 11 is a side view of a silicon quantum dot fluorescent lamp including the cathode assembly shown in FIG. 3 and the anode assembly shown in FIG. 8.
Figure 12:
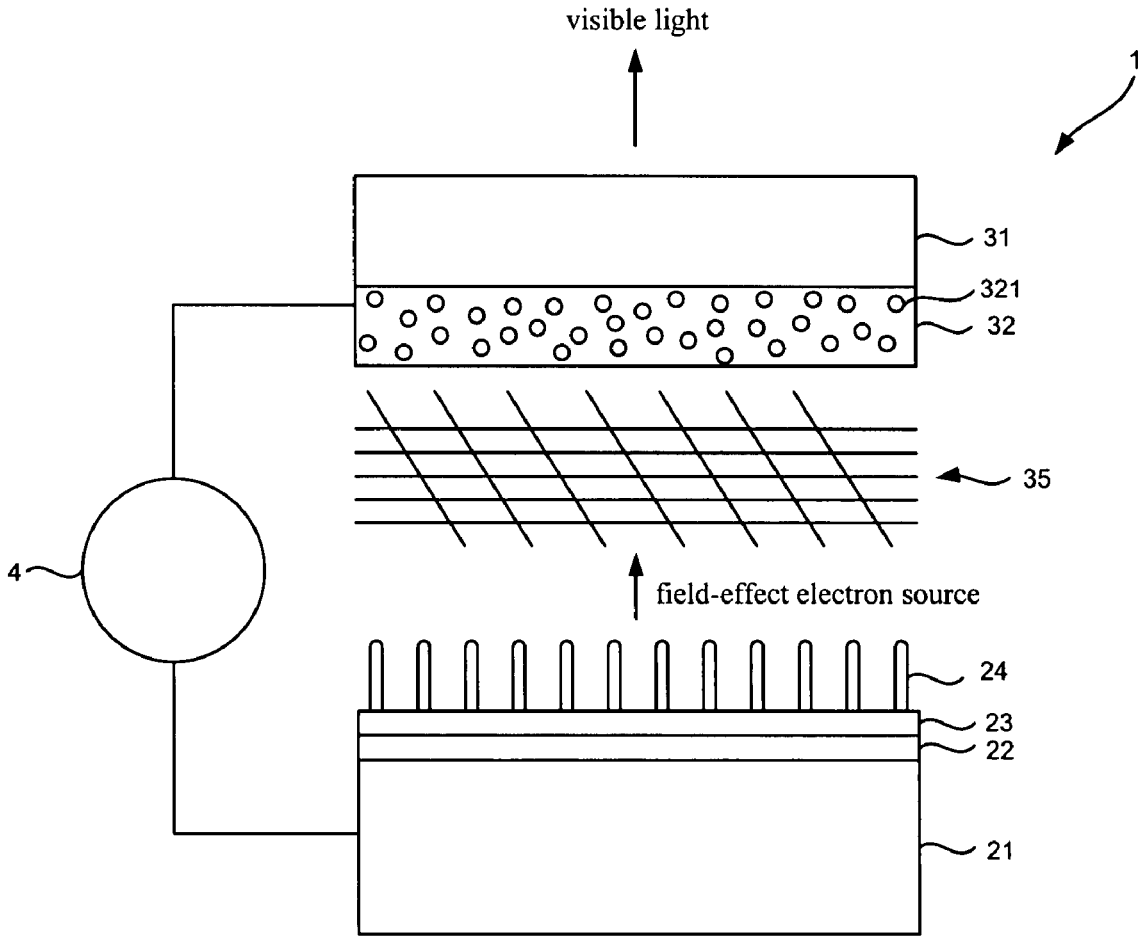
FIG. 12 is a side view of a silicon quantum dot fluorescent lamp including the cathode assembly shown in FIG. 3 and the anode assembly shown in FIG. 9.
Figure 13:
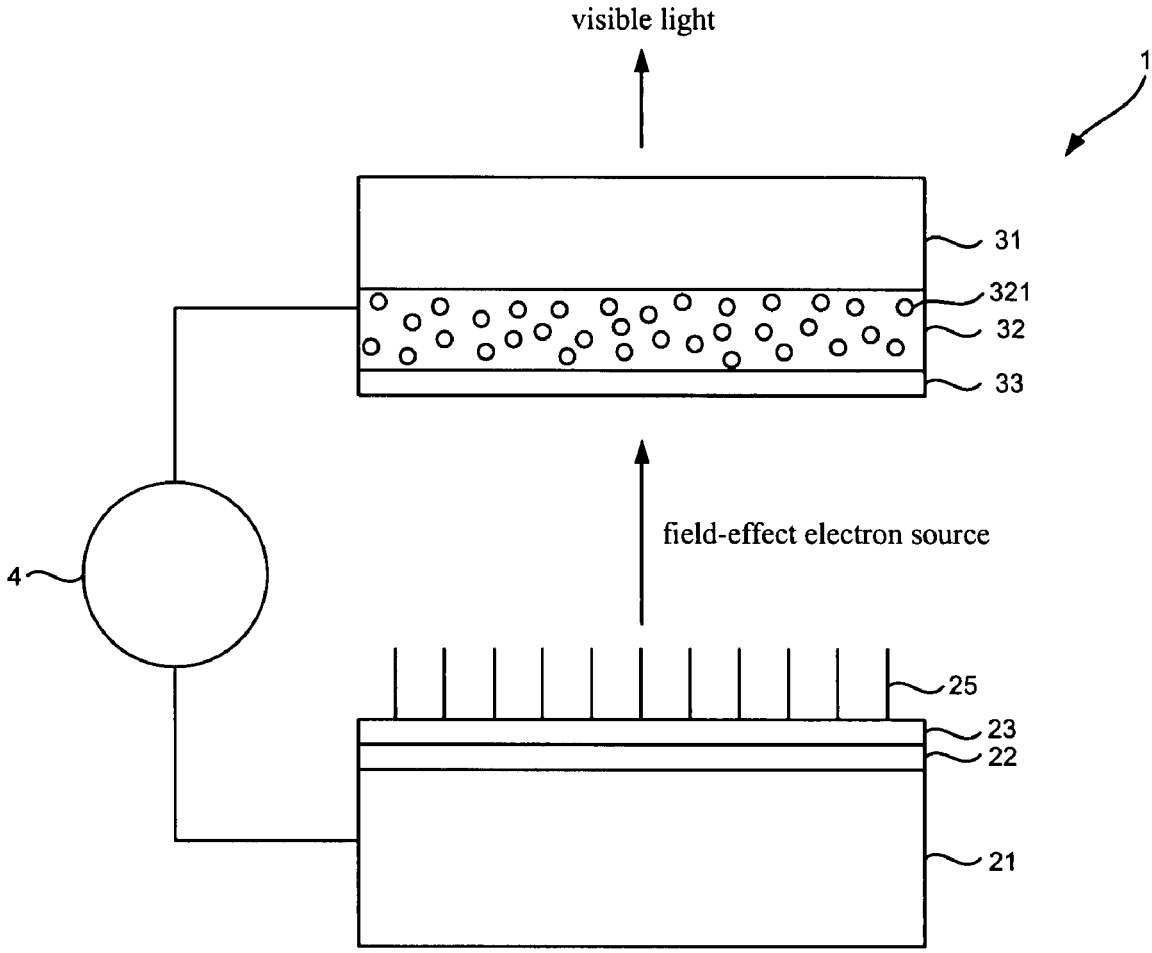
FIG. 13 is a side view of a silicon quantum dot fluorescent lamp including the cathode assembly shown in FIG. 4 and the anode assembly shown in FIG. 7.
Figure 14:
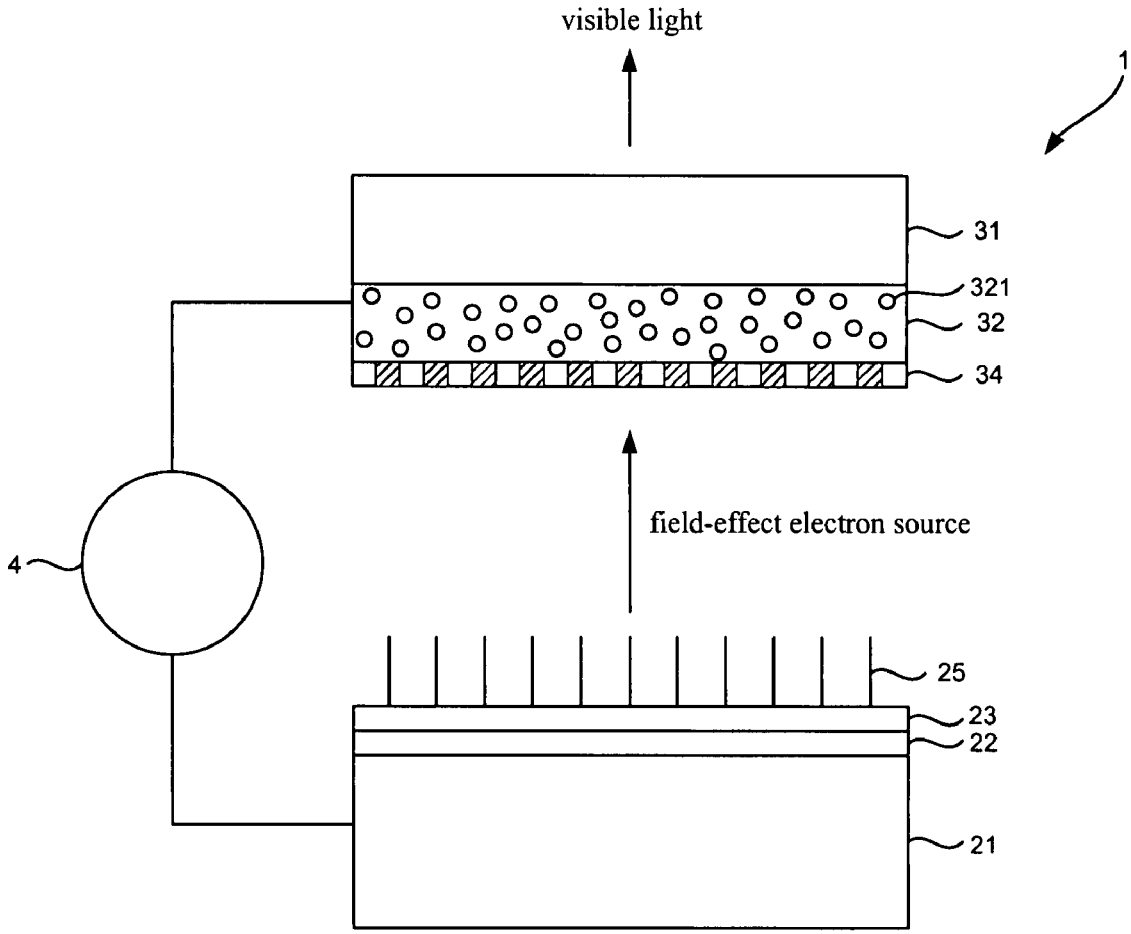
FIG. 14 is a side view of a silicon quantum dot fluorescent lamp including the cathode assembly shown in FIG. 4 and the anode assembly shown in FIG. 8.
Figure 15:
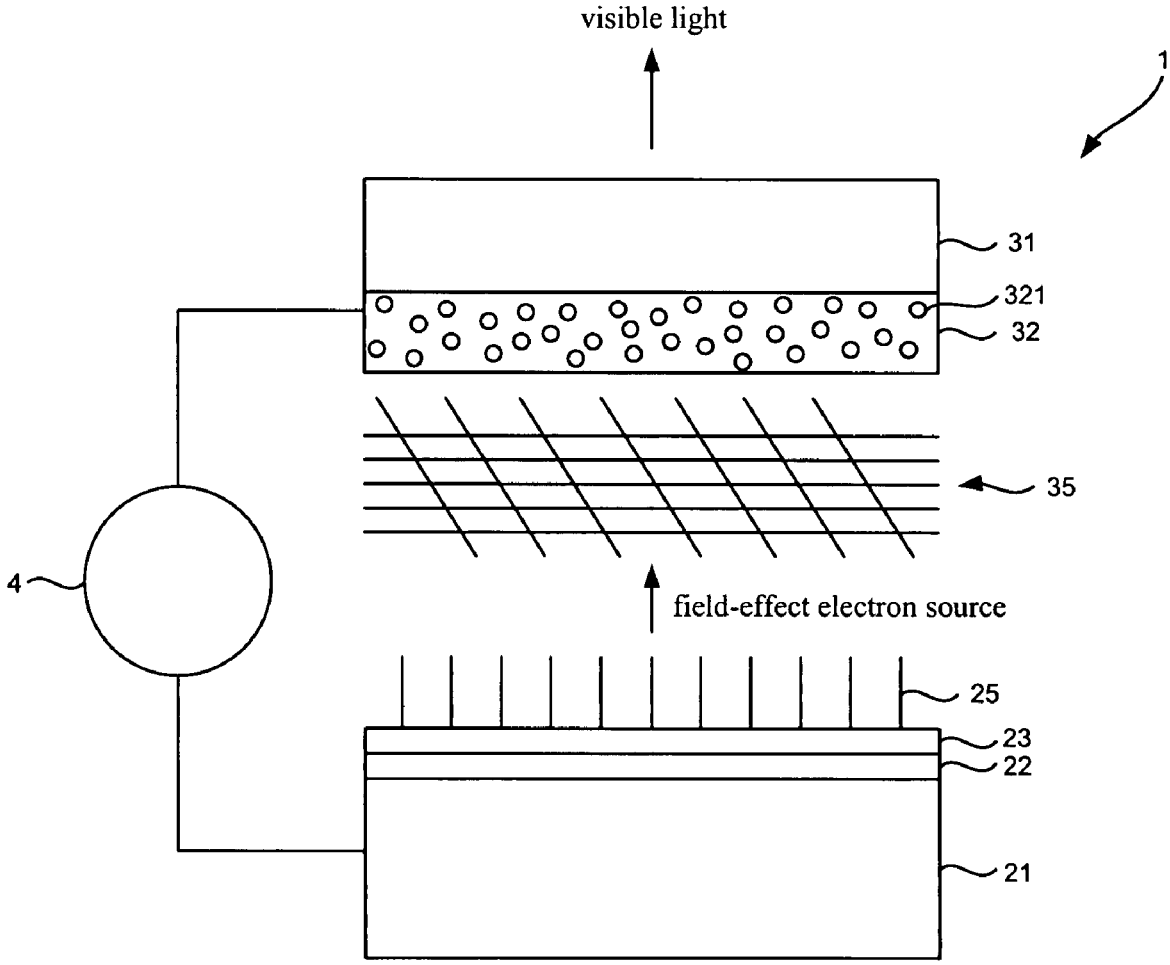
FIG. 15 is a side view of a silicon quantum dot fluorescent lamp including the cathode assembly shown in FIG. 4 and the anode assembly shown in FIG. 9.

Referring to FIGS. 7 through 9, at 15, in an e-gun evaporation system or a sputtering system, the silicon quantum dot fluorescent film 32 is coated with a metal film 33, a patterned metal film 34 or a metal mesh 35, thus forming an anode assembly 3. The metal film 33, the patterned metal film 34 or the metal mesh 35 transfers heat efficiently and provides electrons in addition to electrons released from the nanometer carbon tubes 24 or the nanometer silicon wires 25. Each of the metal film 33, the patterned metal film 34 and the metal mesh 35 is made of gold, silver, copper or aluminum.

Referring to FIGS. 10 through 15, at 16, the nanometer carbon tubes 24 or the nanometer silicon wires 25, which can discharge at the tips, are connected to an external high voltage source 4, thus forming a field-effect electron source. The high voltage source 4 generates a voltage difference between the cathode assembly and the anode assembly, thus generating a field-effect electric field for accelerating the electrons in the field-effect electron source. The electrons hit and excite the silicon quantum dot 321 in the silicon quantum dot fluorescent film 32 to emit visible light.

The anode assembly consisting of the silicon quantum dot film 32 and the metal film 33, the patterned metal film 34 or the metal mesh 35 increases the transfer of heat and the number of the electrons.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A method for making a silicon quantum dot fluorescent lamp, the method comprising the steps of:

providing a first substrate;

coating the first substrate with a buffer layer of titanium;

coating the buffer layer with a catalytic layer of a material selected from a group consisting of nickel, aluminum and platinum; and providing a plurality of nanometer discharging elements on the catalytic layer so that the first substrate, the buffer layer, the catalytic layer and the nanometer discharging elements form a cathode assembly;

providing a second substrate;

coating the second substrate with a silicon quantum dot fluorescent film;

coating the silicon quantum dot fluorescent film with a metal film so that the second substrate, the silicon quantum dot fluorescent film and the metal film form an anode assembly; and providing a high voltage source between the cathode and anode assemblies to generate a field-effect electric field to cause the nanometer discharging elements to release electrons and accelerate the electrons to excite the silicon quantum dot fluorescent film to emit visible light.

2. The method according to claim 1, wherein the first substrate is made of a material selected from a group consisting of silicon, glass, ceramic and stainless steel.

3. The method according to claim 1, wherein the nanometer discharging elements are nanometer carbon tubes provided in a chemical vapor deposition process in which a carbon source is selected from a group consisting of ethane and methane.

4. The method according to claim 1, wherein the nanometer discharging elements are nanometer silicon wires provided in a chemical vapor deposition process in which a silicon source is selected from a group consisting of monosilane and dichlorosilane.

5. The method according to claim 1, wherein the second substrate is transparent.

6. The method according to claim 1, wherein the second substrate is made of a material selected from a group consisting of glass, quartz and sapphire.

7. The method according to claim 1, wherein the silicon quantum dot fluorescent film is made of a material selected from a group consisting of polymer, silicon oxide, silicon nitride and silicon carbide.

8. The method according to claim 1, wherein the silicon quantum dot fluorescent film is made with a high dielectric coefficient.

9. The method according to claim 1, wherein the silicon quantum dots are made of various sizes of 1 to 10 nanometers.

10. The method according to claim 1, wherein the metal film is a patterned metal film.

11. The method according to claim 1, wherein the metal film is a patterned metal mesh.

12. The method according to claim 1, wherein the metal film is made of a material selected from a group consisting of gold, silver, copper and aluminum.

13. The method according to claim 1, wherein the high voltage source generates a voltage difference between the cathode and anode assemblies to generate a field-effect electric field to accelerate the electrons in the cathode assembly.

14. The method according to claim 1, wherein the first substrate is coated with the buffer layer by a device selected from a group consisting of an e-gun evaporation system or a sputtering system.

15. The method according to claim 1, wherein the buffer layer is coated with the catalytic layer by a device selected from a group consisting of an e-gun evaporation system or a sputtering system.

16. The method according to claim 1, wherein the second substrate is coated with the silicon quantum dot fluorescent film in a chemical vapor deposition process.

* * * * *